US010550484B2

(12) United States Patent
Takeda et al.

(10) Patent No.: US 10,550,484 B2
(45) Date of Patent: Feb. 4, 2020

(54) METHOD OF GENERATING ORGANIC COMPOUND AND ORGANIC COMPOUND-GENERATING SYSTEM

(71) Applicants: Chiyoda Corporation, Kanagawa (JP); The University of Tokyo, Tokyo (JP)

(72) Inventors: Dai Takeda, Kanagawa (JP); Akihiro Mutou, Kanagawa (JP); Chikako Hashimoto, Kanagawa (JP); Jun Matsumoto, Kanagawa (JP); Katsushi Fujii, Tokyo (JP); Masakazu Sugiyama, Tokyo (JP)

(73) Assignees: CHIYODA CORPORATION, Kanagawa (JP); The University of Tokyo, Tokyo (JP)

( * ) Notice: Subject to any disclaimer, the term of this patent is extended or adjusted under 35 U.S.C. 154(b) by 0 days.

(21) Appl. No.: 14/997,681

(22) Filed: Jan. 18, 2016

(65) Prior Publication Data

US 2016/0208396 A1 Jul. 21, 2016

(30) Foreign Application Priority Data

Jan. 20, 2015 (JP) ..... 2015-008337

(51) Int. Cl.

| | |
|---|---|
| ***C25B 3/04*** | (2006.01) |
| ***C25B 15/02*** | (2006.01) |
| ***C25B 9/06*** | (2006.01) |

(52) U.S. Cl.

CPC ..... *C25B 3/04* (2013.01); *C25B 9/06* (2013.01); *C25B 15/02* (2013.01)

(58) Field of Classification Search

CPC .... C25B 3/04; C25B 9/06; C25B 9/20; C25B 15/02; C25B 15/08

See application file for complete search history.

(56) References Cited

U.S. PATENT DOCUMENTS

| | | | | |
|---|---|---|---|---|
| 8,357,270 | B2 | 1/2013 | Gilliam | |
| 8,894,830 | B2 | 11/2014 | Gilliam | |
| 2008/0029404 | A1* | 2/2008 | Weber | C01B 7/04 205/556 |
| 2008/0092589 | A1* | 4/2008 | Tranier | B01D 53/1475 62/640 |

(Continued)

FOREIGN PATENT DOCUMENTS

| | | | |
|---|---|---|---|
| JP | S5482375 | A | 6/1979 |
| JP | S5964786 | A | 4/1984 |

(Continued)

OTHER PUBLICATIONS

Japan Patent Office, Notification of Reasons for Refusal, Application No. 2015-008337, dated Oct. 19, 2018, 6 pages.

(Continued)

*Primary Examiner* — Ciel P Thomas

(74) *Attorney, Agent, or Firm* — Quarles & Brady LLP

(57) ABSTRACT

The present invention provides a method of generating organic compounds and an organic-compound-generating system capable of efficiently generating organic-compounds even under a low-temperature environment by controlling a pH of an aqueous solution within a range from 5 to 10 during electrolysis in a case generating organic compounds by electrolyzing the aqueous solution containing carbon dioxide.

6 Claims, 8 Drawing Sheets

(56) References Cited

U.S. PATENT DOCUMENTS

| | | | | |
|---|---|---|---|---|
| 2008/0223727 | A1* | 9/2008 | Oloman | B01D 53/326 205/413 |
| 2010/0230293 | A1* | 9/2010 | Gilliam | C02F 1/46109 205/349 |
| 2013/0118911 | A1* | 5/2013 | Sivasankar | C25B 9/10 205/455 |
| 2014/0151240 | A1* | 6/2014 | Bedell | C25B 9/08 205/455 |
| 2014/0206895 | A1* | 7/2014 | Twardowski | C07C 51/347 560/204 |
| 2015/0267309 | A1* | 9/2015 | Kaczur | C25B 11/02 204/263 |

FOREIGN PATENT DOCUMENTS

| | | | |
|---|---|---|---|
| JP | H0751534 | A | 2/1995 |
| JP | 2013119556 | A1 | 6/2013 |
| JP | 2013536319 | A | 9/2013 |

OTHER PUBLICATIONS

Japan Patent Office, Decision of Refusal, Application No. 2015-008337, dated Apr. 25, 2019, 3 pages, with associate translation.

* cited by examiner

METHOD OF GENERATING ORGANIC COMPOUND AND ORGANIC COMPOUND-GENERATING SYSTEM

CROSS-REFERENCE TO RELATED APPLICATION

This application claims the benefit of Japanese Patent Application No. 2015-008337, filed on Jan. 20, 2015, the entire disclosure of which is incorporated by reference herein.

FIELD

The present invention relates to the method of generating organic compound and the organic compound-generating system for generating organic compound from carbon dioxide.

BACKGROUND

In recent years, suppression for the emission amount of carbon dioxide has become a matter of grave concern because of the impacts of the global warming due to an increase of carbon dioxide.

For instance, in the fuel production apparatus as disclosed in JP 2013-119556, steam and carbon dioxide after its amount of flowing is adjusted so as to be a prescribed molar ratio, steam and carbon dioxide are delivered to the cathode electrode among the anode and cathode electrodes to which electric power is supplied, so as to be electrolyzed. Then, the hydrogen and the carbon monoxide produced by this electrolysis are subjected to be pressurized and are cooled, and subsequently fuel is synthesized by utilizing a catalyst. In this fuel production apparatus, the efficiency of synthesizing the fuel is enhanced by heating steam and carbon dioxide to a high temperature, whereby carbon dioxide emissions is made suppressed.

However, in the above fuel production apparatus, since steam and carbon dioxide is heated to a high temperature of 600 degrees Celsius to 1100 degrees Celsius in order to facilitate electrolysis, a device configuration in order to obtain such a high-temperature environment becomes complicated, and such a problem occurred that the amount of energy used except for the electrolysis becomes surplus.

The present invention aims to resolve such a problem. That is, the present invention aims to provide a method of generating organic compounds and an organic-compound-generating system by which the organic compounds can be produced even under low-temperature environment.

We, the inventors of the present invention have adopted a method in which an aqueous solution containing carbon dioxide is subjected to be electrolyzed so as to produce organic compounds, and have discovered after repeated intensive studies focusing on a pH of the aqueous solution in the method that organic compounds can be efficiently produced when the pH of the aqueous solution is within a specified range under low-temperature environment.

SUMMARY

One aspect of the present invention, in order to attain the aforementioned objective, provides a method for generating organic compounds by electrolyzing an aqueous solution containing carbon dioxide, including: controlling a pH of the aqueous solution within a range from 5 to 10 during an electrolysis.

A first preferred aspect of the present invention provides the method of generating organic compounds according to the one aspect of the present invention including: an aqueous-solution-generation process in which carbon dioxide is subjected to be absorbed in water in a generation vessel so that aqueous solution is generated; a transferring process in which the aqueous solution is transferred from the generation vessel to another electrolytic cell independent from the generation vessel; and an electrolytic process in which the aqueous solution is subjected to be electrolyzed in the electrolytic cell, wherein the pH of the aqueous solution is controlled so as to be within the range from 5 to 10 in the generation vessel.

A second preferred aspect of the present invention provides the method of generating organic compounds according to the first preferred aspect of the present invention, wherein during electrolysis, the aqueous solution in the electrolytic cell is made to flow.

A third preferred aspect of the present invention provides the method of generating organic compounds according to any one of the precedent claims, the pH of the aqueous solution is controlled so as to be within the range from 5 to 10 during the electrolysis by adding a basic substance in the aqueous solution.

An another aspect of the present invention, in order to attain the aforementioned objective, provides a system for generating organic compounds, including: an aqueous-solution-generation section for generating an aqueous solution in which carbon dioxide is made to be absorbed; an electrolytic section in which the aqueous solution that has been generated in the aqueous-solution-generation section is subjected to be electrolyzed; and the pH controller for, controlling the pH of the aqueous solution during the electrolysis so as to be within the range from 5 to 10.

A first preferred aspect of the present invention provides the system for generating organic compounds according to the another aspect of the present invention, wherein the aqueous-solution-generation section is adapted to include a generation vessel in which carbon dioxide is absorbed in water so that the aqueous solution is produced, the electrolytic section is adapted to include an electrolytic cell independent from the generation vessel in which the aqueous solution is subject to be electrolyzed, and the pH controller controls the pH of the aqueous solution so as to be within the range from 5 to 10 in the generation vessel, wherein the system for generating organic compounds further includes a transferring unit which transfers the aqueous solution from the generation vessel to the electrolytic cell.

A second preferred aspect of the present invention provides the system for generating organic compounds according to the first preferred aspect of the present invention, further including a fluidity-providing section for subjecting the aqueous solution in the electrolytic cell to be fluidized.

A third preferred aspect of the present invention provides the system for generating organic compounds according to the second preferred aspect of the present invention, wherein the electrolytic section is adapted to include a plurality of positive electrodes and a plurality of negative electrodes arranged alternately in the electrolytic cell and a plurality of membranes which partitions an inside of the electrolytic cell into a plurality of accommodation portions, the accommodation portions individually accommodating the plurality of positive electrodes and the plurality of negative electrodes, and is configured such that the aqueous solution is discharged from the electrolytic cell immediately after being separated into the plurality of accommodation portions and being flown in one direction as well as being passed therethrough.

A fourth preferred aspect of the present invention provides the system for generating organic compounds according to the second preferred aspect of the present invention, wherein the electrolytic section is adapted to include the plurality of positive electrodes and the plurality of negative electrodes arranged alternately and a plurality of membranes which partitions an inside of the electrolytic cell into a plurality of accommodation portions, the accommodation portions individually accommodating the plurality of positive electrodes and the plurality of negative electrodes, wherein the aqueous solution is flown in one direction only within the accommodation portions accommodating the plurality of negative electrodes among the plurality of accommodation portions and is discharged from the electrolytic cell immediately after being passed through the accommodation portions, and wherein another electrolyte aqueous solution separated from the aqueous solution is flown in one direction only within the accommodation portions accommodating the plurality of positive electrodes among the plurality of accommodation portions and is discharged from the electrolytic cell immediately after being passed through the accommodation portions.

A fifth preferred aspect of the present invention provides the system for generating organic compounds according to the third or the fourth preferred aspect of the present invention, wherein the plurality of positive electrodes and the plurality of negative electrodes are respectively formed in a plate-like shape and are respectively arranged in parallel to each other, and the positive electrode and the negative electrode being adjacent to each other among the plurality of positive electrodes and the plurality of negative electrodes are adapted to each form a set consisted of a positive electrode and a negative electrode, and wherein an inter-electrode-space distance between the positive electrode and the negative electrode that form the set is equal to or less than 2.5 mm.

A sixth preferred aspect of the present invention provides the system for generating organic compounds according to the fifth preferred aspect of the present invention, wherein one plurality of electrodes of at least one of the plurality of positive electrodes and the plurality of negative electrodes is provided with one or more apertures.

A seventh preferred aspect of the present invention provides the system for generating organic compounds according to any one of the relevant precedent claims, wherein the pH controller is adapted to control the pH of the aqueous solution within the range from 5 to 10 by adding a basic substance in the aqueous solution during the electrolysis.

An eighth preferred aspect of the present invention provides the system for generating organic compounds according to any one of the relevant precedent claims, further including an organic compound-extraction apparatus which is adapted to extract extraction apparatus, wherein the organic compound-extraction apparatus includes at least one of the gaseous-organic compound-extraction section and the liquid-organic-compound-extraction section, and wherein the gaseous-organic-compound-extraction section is adapted to extract organic compounds contained in gases generated by the electrolysis conducted by the electrolytic section, and the liquid-organic-compound-extraction section is adapted to extract organic compounds contained in the aqueous solution on which the electrolysis has been conducted.

A ninth preferred aspect of the present invention provides the system for generating organic compounds according to the eighth preferred aspect of the present invention, wherein the organic-compound-extraction apparatus includes the liquid-organic-compound-extraction section, and wherein the system for generating organic compounds further includes a liquid-delivering section that delivers the aqueous solution from which the organic compounds have been extracted by the liquid-organic-compound-extraction section to the aqueous-solution-generation section.

According to the one aspect of the present invention, there is provided a control of the pH of the aqueous solution containing carbon dioxide within a range from 5 to 10 during the electrolysis. As such, the equilibrium state of the aqueous solution is made to be inclined to a state where the hydrogen carbonate ion is to be increased. Thereby, a greater number of hydrogen carbonate is electrolyzed resulting in a production of many organic compounds. Accordingly, the organic compounds can be generated efficiently even under a low-temperature environment.

According to the first preferred aspect of the present invention, carbon dioxide is subjected to be absorbed in water in a generation vessel so that the aqueous solution is generated, the aqueous solution is transferred from the generation vessel to another electrolytic cell independent from the generation vessel, the aqueous solution is subjected to electrolysis in the electrolytic cell, and the pH of the aqueous solution is controlled so as to be within the range from 5 to 10. As such, since the aqueous solution is transferred from the gas-absorption tank where the pH thereof is controlled to the electrolyze tank independent from the gas-absorption tank, for instance, as compared to the case where generation and electrolysis of the aqueous solution are performed concurrently within a single cell, the effect due to the variation of the pH by electrolysis during the control of the pH is made minimized. Thereby, the pH of the aqueous solution can be controlled avoiding a decline of the precision of the control. Accordingly, the organic compounds can be generated more efficiently even under a low-temperature environment.

According to the second preferred aspect of the present invention, during the electrolysis, the aqueous solution in the electrolytic cell is made to flow. As such, the bubbles having been generated on the surface of the electrode by means of electrolysis are flown to be eliminated. Thereby, an increase of the electric resistance due to the presence of the bubbles can be suppressed. Accordingly, the organic compounds can be generated more efficiently even under a low-temperature environment.

According to the third preferred aspect of the present invention, the pH of the aqueous solution is controlled so as to be within the range from 5 to 10 during the electrolysis by adding a basic substance in the aqueous solution having absorbed carbon dioxide or water used for a solvent thereof. As such, for instance, as compared to the case controlling the pH by adjusting the amount of contained oxygen (i.e., concentration), the addition of the basic substance can make the control of the pH of the aqueous solution more precise and easier. Accordingly, the organic compounds can be generated more efficiently even under a low-temperature environment.

According to the another aspect of the present invention, including an aqueous-solution-generation section for generating an aqueous solution in which carbon dioxide is made to be absorbed, an electrolytic section in which the aqueous solution that has been generated in the aqueous-solution-generation section is subjected to electrolysis, and the pH controller for controlling the pH of the aqueous solution during the electrolysis so as to be within the range from 5 to 10. As such, the equilibrium state of the aqueous solution is made to be inclined to a state where the hydrogen carbonate ion is to be increased. Thereby, a greater number of hydrogen carbonate is electrolyzed resulting in a production of many organic compounds. Accordingly, the organic compounds can be generated efficiently even under a low-temperature environment.

According to the first preferred aspect of the present invention, the aqueous-solution-generation section is adapted to include a generation vessel in which carbon dioxide is absorbed in water so that the aqueous solution having absorbed carbon dioxide is produced, the electrolytic section is adapted to include an electrolytic cell independent from the generation vessel, in which the aqueous solution is subject to be electrolyzed, and the pH controller controls the pH of the aqueous solution so as to be within the range from 5 to 10 in the generation vessel, and wherein the system for generating organic compounds further includes a transferring unit which transfers the aqueous solution from the generation vessel to the electrolytic cell. As such, since the aqueous solution is transferred from the generation vessel where the pH thereof is controlled to the electrolytic cell, for instance, as compared to the case where generation and electrolysis of the aqueous solution are performed concurrently within a single cell, the effect due to the variation of the pH by electrolysis during the control of the pH is made minimized. Thereby, the pH of the aqueous solution can be controlled avoiding a decline of the precision of the control. Accordingly, the organic compounds can be generated efficiently even under a low-temperature environment.

According to the second preferred aspect of the present invention, further includes a fluidity-providing section for subjecting the aqueous solution in the electrolytic cell to flow. As such, the bubbles generated on the surface of the electrode is made flown to be eliminated by means of the electrolysis, thereby, the increase of the electric resistance due to the presence of the bubbles can be suppressed. Accordingly, the organic compounds can be generated more efficiently even under a low-temperature environment.

According to the third preferred aspect of the present invention, the aqueous solution having absorbed carbon dioxide is discharged from the electrolytic cell immediately after being separated into the plurality of accommodation portions individually accommodating the plurality of positive electrodes and the plurality of negative electrodes and being flown in one direction as well as being passed therethrough. As such, although the aqueous solution at the positive electrode side after the electrolysis contains the oxygen generated on the positive electrode surface by the electrolysis, the oxygen can be prevented from contacting the positive electrode again. Further, since the positive electrode and the negative electrode are separated from each other by the membrane, the oxygen can also be prevented from contacting the negative electrode. Accordingly, a decline of the electrode by the contact of the oxygen can be prevented. Accordingly, the organic compounds can be generated more efficiently even under a low-temperature environment.

According to the fourth preferred aspect of the present invention, the aqueous solution having absorbed the carbon dioxide is discharged from the electrolytic cell immediately after being separated into the plurality of accommodation portions individually accommodating the plurality of positive electrodes and the plurality of negative electrodes, and being flown in one direction as well as being passed therethrough. Further, another electrolyte aqueous solution separated from the aqueous solution is flown in one direction only within the accommodation portions accommodating the plurality of positive electrodes among the plurality of accommodation portions and is discharged from the electrolytic cell immediately after being passed through the accommodation portions. As such, although the aqueous solution at the positive electrode side is likely to contain the oxygen generated on the surface of the positive electrode by the electrolysis, the oxygen is prevented from contacting the positive electrode again. Further, since the positive electrode and the negative electrode are separated from each other by the membrane, the oxygen can also be prevented from contacting the negative electrode. Furthermore, in the configuration in which the aqueous solution is reused after being electrolyzed, although there is likely to be dissolved the oxygen generated by electrolysis in such a reused aqueous solution, the dissolved oxygen can be prevented from contacting the negative electrode by separating the electrolyte aqueous solution at the positive electrode side from the aqueous solution at the negative electrode side. Thus, a decline of the electrode by the contact of the oxygen can be suppressed. Accordingly, the organic compounds can be generated more efficiently even under a low-temperature environment.

According to the fifth preferred aspect of the present invention, the plurality of positive electrodes and the plurality of negative electrodes are respectively formed in a plate-like shape and are respectively arranged in parallel, and the positive electrode and the negative electrode being adjacent to each other among the plurality of positive electrodes and the plurality of negative electrodes are adapted to each form a set consisted of a positive electrode and a negative electrode, and an inter-electrode-space distance between the positive electrode and the negative electrode that form the set is equal to or less than 2.5 mm. As such, during the electrolysis, although in normal, the narrower are the intervals between the electrodes, the more enhanced is the efficiency of the electrolysis, while the aqueous solution is prevented from flowing at the inter-electrode, and thereby, a removal of the bubbles is suppressed and a favorable maintenance of the efficiency is made difficult, the intervals of the plurality of positive electrodes and the plurality of negative electrodes are set within the above-described numerical range so that the efficiency and the maintenance of the electrolysis can be made well-balanced.

According to the sixth preferred aspect of the present invention, one plurality of electrodes of at least one of the plurality of positive electrodes and the plurality of negative electrodes is provided with one or more apertures. As such, the aqueous solution is made more easily flown through the inter-electrode space so that the removal of the bubbles is facilitated, and the efficiency of the electrolysis can be more suitably maintained.

According to the seventh preferred aspect of the present invention, the pH controller is adapted to control the pH of the aqueous solution within the range from 5 to 10 by adding a basic substance in the aqueous solution during the electrolysis. As such, as compared to the case controlling the pH by adjusting the amount of contained oxygen (i.e., concentration), the addition of the basic substance can make the control of the pH of the aqueous solution more precise and easier. Accordingly, the organic compounds can be generated more efficiently even under a low-temperature environment.

According to the eighth preferred aspect of the present invention, further including an organic compound-extraction apparatus which is adapted to extract extraction apparatus, wherein the organic-compound-extraction apparatus includes at least one of the gaseous-organic-compound-extraction section and the liquid-organic-compound-extraction section, wherein the gaseous-organic-compound-extraction section is adapted to extract organic-compounds contained in gases generated by electrolysis conducted by the electrolytic section, and the liquid-organic-compound-extraction section is adapted to extract organic compounds contained in the aqueous solution on which the electrolysis has been conducted. As such, at least one of the gaseous-organic-compound and the water-soluble organic compound generated by the electrolysis can be obtained.

According to the ninth preferred aspect of the present invention, the organic-compound-extraction apparatus the organic-compound-extraction apparatus further includes the liquid-organic-compound-extraction section, and wherein the system for generating organic compound further includes a liquid-delivering section that delivers the aqueous solution from which the organic compounds have been extracted by the liquid-organic-compound-extraction section to the aqueous-solution-generation section. As such, the aqueous solution after the electrolysis can be reused by dissolving carbon dioxide therein again.

DETAILED DESCRIPTION

Hereinafter, an organic-compound-generation apparatus according to one embodiment of the present invention is described with reference to FIGS. 1 to 4.

Figure 1:
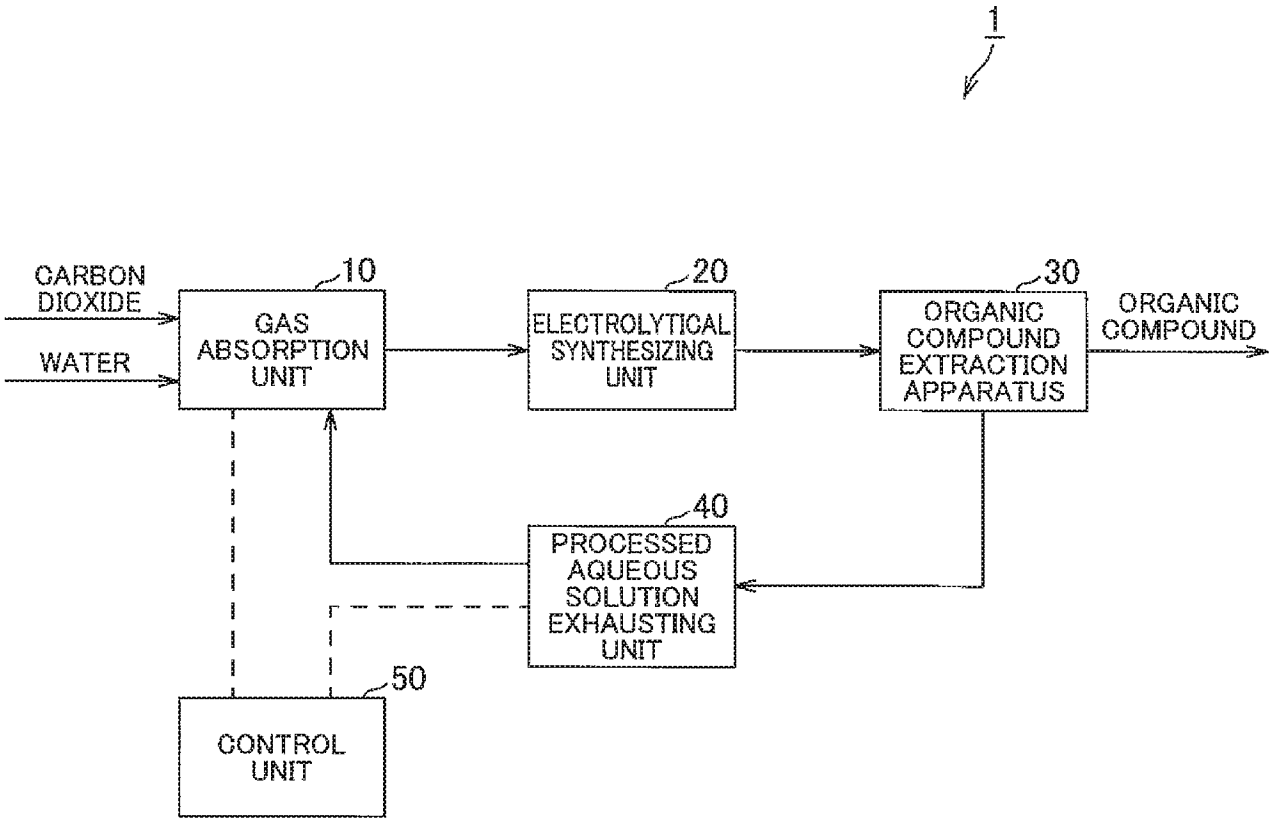
FIG. 1 is a schematic structural view showing an organic-compound-generation apparatus in one embodiment of the present invention.
Figure 2:
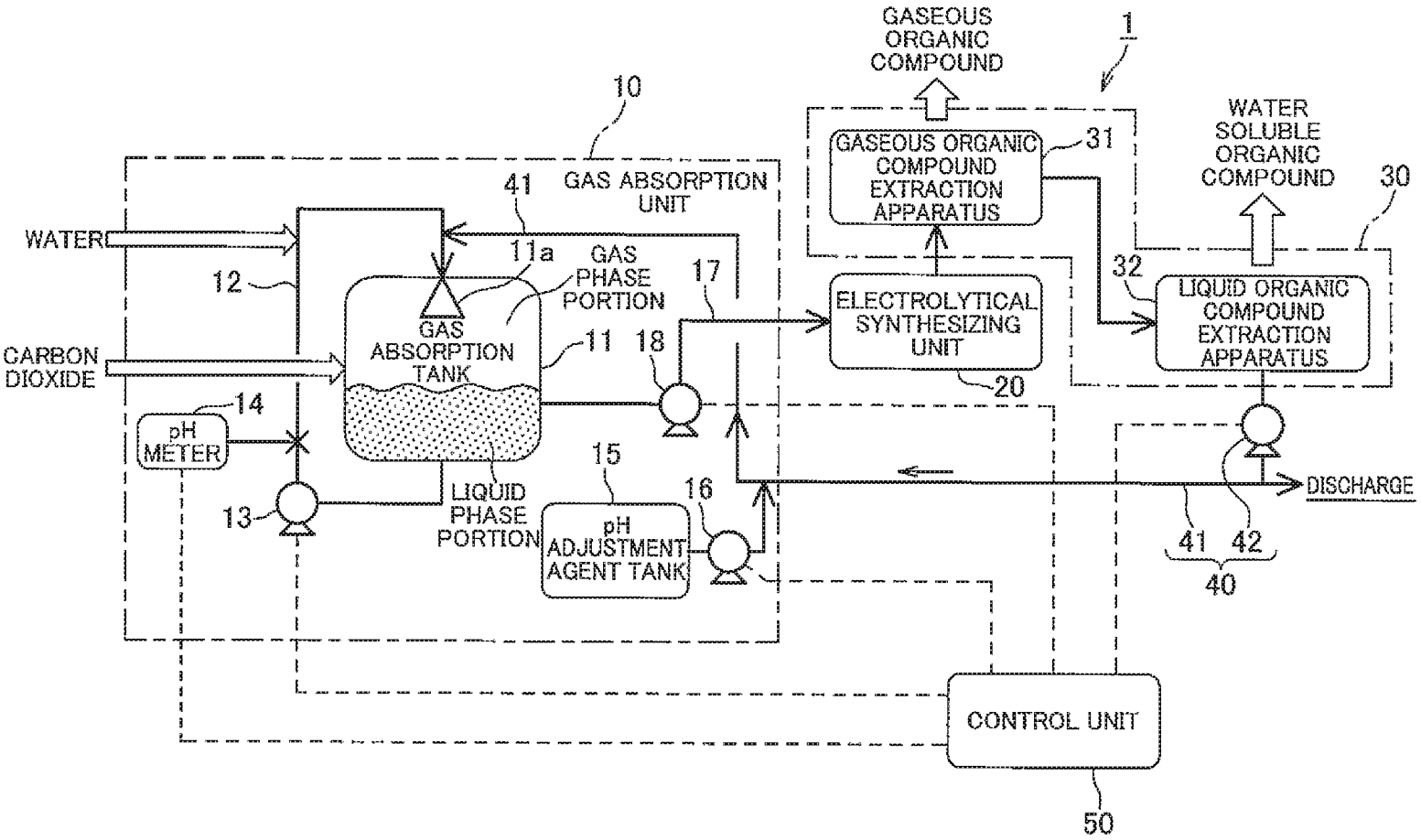
FIG. 2 is an explanatory view showing the configuration of gas-absorption unit equipped in the organic-compound-generation apparatus in FIG. 1.
Figure 3:
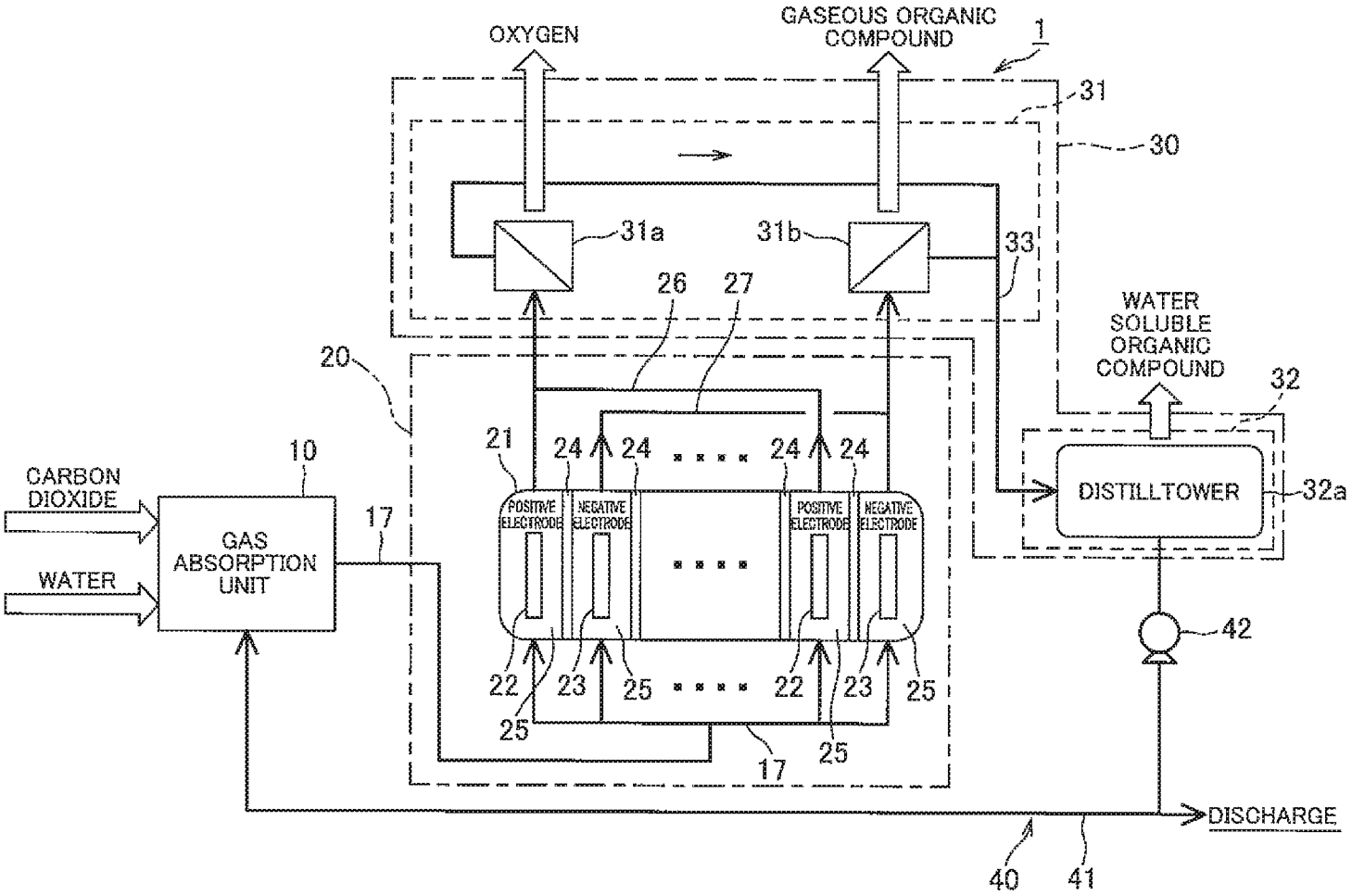
FIG. 3 is an explanatory view showing a configuration of an electrolytical-synthesizing unit and an organic-compound-generation unit equipped in the organic-compound-generation apparatus in FIG. 1.
Figure 4:
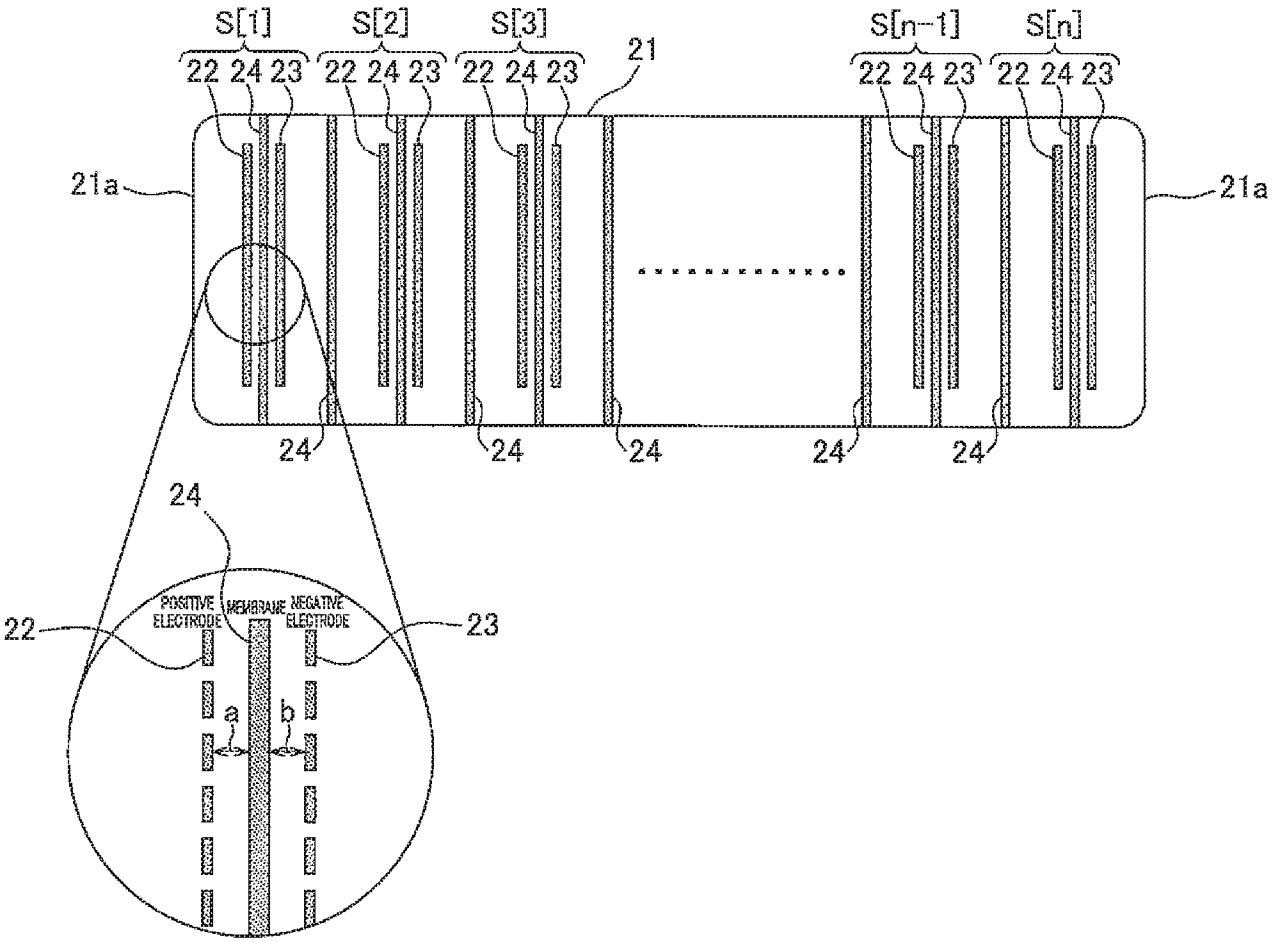
FIG. 4 is an explanatory view showing an arrangement of the positive electrode, the negative electrode and the membrane in the electrolytical-synthesizing unit in FIG. 2.

FIG. 1 is a schematic structural view showing an organic-compound-generation apparatus of one embodiment of the present invention, FIG. 2 is an explanatory view showing the configuration of gas-absorption unit equipped in the organic-compound-generation apparatus in FIG. 1, FIG. 3 is an explanatory view showing a configuration of an electrolytical-synthesizing unit and an organic-compound-generation unit equipped in the organic-compound-generation apparatus in FIG. 1, and FIG. 4 is an explanatory view showing an arrangement of the positive electrode, the negative electrode and the membrane in the electrolytical-synthesizing unit in FIG. 2.

An organic-compound-generation apparatus is adapted to extract water-soluble organic compounds from an electrolyzed aqueous solution which has been obtained by electrolysis with extracting gaseous organic compounds from gases generated when the electrolysis is conducted. The electrolyzed aqueous solution is originally prepared before the electrolysis as an aqueous solution obtained by electrolyzing an aqueous solution which is water having absorbed carbon dioxide ($CO_2$). The extracted organic compounds are, for example, consisted of at least one gas of methane ($CH_4$), ethane ($C_2H_6$), ethylene ($C_2H_4$), methanol ($CH_4O$), ethanol ($C_2H_6O$), propanol ($C_3H_8O$), formaldehyde ($CH_2O$) and formic acid ($CH_2O_2$) or the like. Of course, these are merely shown as one example, thus, other organic compounds which differ from those organic compounds are possibly generated by controlling various conditions As shown in FIG. 1, the organic-compound-generation apparatus 1 of this embodiment is composed of a gas-absorption unit 10 as an aqueous-solution-generation section, an electrolytical-synthesizing unit 20 as an electrolytic section, an organic-compound-extraction apparatus 30, a processed-aqueous solution-exhausting unit 40 as a liquid-delivering section and a control unit 50 as a pH controller.

The gas-absorption unit 10 is adapted to generate an aqueous solution which is water having absorbed carbon dioxide. Further, in the gas-absorption unit 10, the pH of the generated aqueous solution is controlled so as to be within a specified range. As shown in FIG. 2, the gas-absorption unit 10 is composed of a gas-absorption tank 11 as a generation vessel, a pH-measurement pipe 12, a pH-measurement pump 13, a pH meter 14, a pH-adjustment-agent tank 15, a chemicals feed pump 16, a transferring pipe 17 and a transferring pump 18.

The gas-absorption tank 11 is configured as a vessel which generates therein an aqueous solution in which carbon dioxide is made absorbed. The gas-absorption tank 11 is connected to a not-shown pipe which is adapted to deliver gaseous carbon dioxide from exterior environment to a gas-phase portion and a not-shown pipe which is adapted to discharge excessive carbon dioxide from the gas-phase portion. At the interior of the ceiling wall, there is provided a vaporizer 11*a*. The gas-absorption tank 11 is provided with a not-shown temperature-adjustment apparatus by which the temperature of the aqueous solution inside thereof is enabled to be controlled.

The one end of the pH-measurement pipe 12 is connected to an liquid-phase portion of the gas-absorption tank 11, and the other end thereof is connected to the vaporizer 11*a*. The pH-measurement pipe 12 is connected to a processed-aqueous solution pipe 41 of the processed-aqueous solution-exhausting unit 40 that will be described later such that the fluids which are flown through each of the pipes meet and flow together. Further, the pH-measurement pipe 12 is connected to a not-shown pipe which is adapted to deliver water from exterior environment, such that the fluids which are flown through each of the pipes meet and flow together.

The pH-measurement pump 13 is adapted to render the aqueous solution that is the liquid-phase portion of the gas-absorption tank 11 to flow from the one end of the pH-measurement pipe 12 towards the other end thereof. Thus, the aqueous solution having been flown as far as the other end of the pH-measurement pipe 12 is made sprayed into the gas-phase portion from the vaporizer 11*a*. The misted aqueous solution obtained therefrom is subjected to fall into the liquid-phase portion with absorbing carbon dioxide therein.

The pH meter 14 is adapted to measure the pH of the aqueous solution being flown through pH-measurement pipe 12. The pH meter 14 is connected to the control unit 50 that will be described later, and is adapted to transmit signals corresponding to the measured pH to the control unit 50.

The pH-adjustment-agent tank 15 accommodates a basic substance as chemicals for controlling the pH of the aqueous solution contained in the gas-absorption tank 11. The chemicals are comprised of, for example, at least one substance selected from lithium hydroxide (LiOH), sodium hydroxide (NaOH), potassium hydroxide (KOH), sodium carbonate ($Na_2CO_3$), potassium carbonate ($K_2CO_3$), lithium carbonate ($LiHCO_3$), sodium bicarbonate ($NaHCO_3$), potassium bicarbonate ($KHCO_3$), potassium sulfate ($K_2SO_4$) and sulfuric acid ($H_2SO_4$). Of course, these are shown as one example, and other chemicals which possibly serve as a basic substance when added in the aqueous solution may also be utilized insofar as not contrary to the purpose of the present invention. The aqueous solution in which chemicals are added is subjected to be sprayed from the vaporizer 11*a* and the pH of the aqueous solution contained in the gas-absorption tank 11 is thus made controlled. The chemicals feed pump 16 is connected to the control unit 50 and is adapted to operate on the basis of control signals transmitted from the control unit 50.

The one end of the transferring pipe 17 is connected to the liquid-phase portion of the gas-absorption tank 11 while the other end thereof is connected to the electrolytical-synthesizing unit 20 that will be described later. The transferring pump 18 is adapted to flow the aqueous solution that is the liquid-phase portion in the gas-absorption tank 11 from the one end of the transferring pipe 17 to the other end thereof. Thus, the aqueous solution contained in the gas-absorption tank 11 is transferred to the electrolytical-synthesizing unit 20 via the transferring pipe 17. The transferring pipe 17 and the transferring pump 18 configure a transferring unit that is adapted to render the aqueous solution to be transferred from the gas-absorption unit 10 to the electrolytical-synthesizing unit 20. The transferring pump 18 is connected to the control unit 50 so as to operate responsive to control signals transmitted from the control unit 50.

The electrolytical-synthesizing unit 20 is adapted to electrolyze the aqueous solution having absorbed carbon dioxide. As shown in FIG. 3, the electrolytical-synthesizing unit 20 is comprised of an electrolyze tank 21 as an electrolytic cell, a plurality of positive electrodes 22, a plurality of negative electrodes 23, a plurality of membranes 24, a positive electrode-side discharging pipe 26 and a negative-electrode-side discharging pipe 27.

The electrolyze tank 21 serves as a vessel in which the aqueous solution transferred from the gas-absorption tank 11 is subject to be electrolyzed. In the electrolyze tank 21, there are arranged in a predetermined order, the plurality of positive electrodes 22, the plurality of negative electrodes 23 and the plurality of membranes 24. Specifically in the electrolyze tank 21, as shown in FIG. 4, the positive electrode 22 is arranged in a manner opposing to the negative electrode 23, and one electrodes-set S consisted of the positive and negative electrodes 22, 23, and the membrane 24 disposed therebetween, is arranged in plural (S[1]-S[n]) in one direction (in a horizontal direction in FIG. 4). Further, in the intermediate of any two electrodes-sets adjacent to each other among the multiple electrodes-sets S[1]-S[n], there is disposed the membrane 24 which is not included in those electrodes-sets, and at the either ends of the multiple electrodes-sets S[1]-S[n] in the arrangement direction, there is disposed a part of the electrolyte-layer 21 as a partition-wall 21*a*.

The plurality of positive electrodes 22 is respectively connected to the positive electrodes of a not-shown power supply, and the plurality of negative electrodes 23 is respectively connected to the negative electrodes of the not-shown power supply. Further, between the plurality of positive electrodes 22 and the plurality of negative electrodes 23, a voltage that is appropriate for the electrolysis of the aqueous solution is supplied such that for instance, the current density is equal to or less than 800 $mA/cm^2$ and the reaction temperature in the electrolyze tank 21 is within the range from 20 degrees Celsius to 80 degrees Celsius. Although the power supply is adapted to output a desired voltage and a current powered by a commercial power source, other power supplies that utilize natural energy such as sunlight, solar heat, hydraulic power, wind power, geothermal power or wave power, or a power supply such as fuel battery are also available.

The base material of the plurality of positive electrodes 22 and the plurality of negative electrodes 23 are composed of, for instance, metals such as nickel (Ni), gold (Au), copper (Cu), iron (Fe), lead (Pb) or the like, carbon (C) or conductive ceramic. Of course, these are merely shown as one example, hence, other materials that are suitably used for the electrode for electrolysis may be utilized as well insofar as not contrary to the purpose of the present invention.

Further, the plurality of negative electrodes 23 respectively carries such materials as a material that is widely known as carbon-dioxide reduction-catalyst, for instance, Group 4 element such as titanium (Ti) or the like, Group 8 element such as ruthenium (Ru) or the like, metal material of Group 12 element such as copper (Cu) or oxide composed of such metal, metallic complex composed of these metals, and polypyridine compound or polypyrrole compound, or semiconductor materials such as GaP. Further, the plurality of negative electrodes 23 may be solely consisted of the above described base materials without earring the materials as aforedescribed.

The plurality of positive electrodes 22 and the plurality of negative electrodes 23 are respectively formed in a rectangular, plate-like shape and arranged in parallel to each other. Further, as above described, in the plurality of positive electrodes 22 and the plurality of negative electrodes 23, the positive electrode 22 and the negative electrode 23 adjacent to each other forms a set having the partition-wall 24 therebetween. The inter-electrode-space distance between the positive electrode 22 and the negative electrode 23 included in one electrodes-set S at the lowest shall be equal to or more than 0 mm. More preferably, the inter-electrode-space distance at the lowest is equal to or more than 0.5 mm. Further, the inter-electrode-space distance at the highest is equal to or less than 2.5 mm, and more preferably, is equal to or less than 2 mm. That is, the inter-electrode-space distance is set within the range from 0 mm to 2.5 mm. Preferably, the inter-electrode-space distance is set within the range from 0.5 mm to 2 mm. Here, the inter-electrode-space distance means a distance obtained by subtracting the thickness of the membrane 24 from the distance between the positive electrode 22 and the negative electrode 23. The inter-electrode-space distance is equivalent to a distance a between the positive electrode 22 and the membrane 24 plus a distance b between the negative electrode 23 and the membrane 24 (FIG. 4). For instance, that the inter-electrode-space distance is 0 mm means a state where the positive electrode 22 and the negative electrode 23 are in contact with the membrane 24 disposed therebetween. When the inter-electrode-space distance is too long, a higher voltage must be supplied, whereas the inter-electrode-space distance is too short, the aqueous solution becomes unlikely to flow and the electric resistance is increased since the bubbles generated on the surface of the electrodes (i.e., the positive electrode 22 and the negative electrode 23) remain unevolved on this surface. Therefore, setting the inter-electrode-space distance within the above-described numerical range is capable of placing the above conditions in a well-balanced state.

The plurality of positive electrodes 22 and the plurality of negative electrodes 23 are respectively provided with a plurality of apertures arranged entirely and uniformly (in a mesh-like state). Further, in the plurality of positive electrodes 22 and the plurality of negative electrodes 23, apertures having comparatively larger size may be provided in singular or several. The apertures are formed, for instance, in a circular, polygonal, or pentagram shape. As such, the positive electrode 22 and the negative electrode 23 are respectively provided with apertures so that the aqueous solution is more likely to flow around the positive electrode 22 and the negative electrode 23. In the enlarged circle in FIG. 4, the positive electrode 22 and the negative electrode 23 are respectively illustrated in a dotted line so as to express a plurality of apertures is provided therethrough.

Further, the apertures are provided so that the ratio (aperture ratio) of the total areas of apertures to the external projected area of the plurality of positive electrodes 22 and the plurality of negative electrodes 23 is within the range from 10% to 70%, more preferably, the apertures are provided so that the aperture ratio is within the range from 20% to 60%. This is because when the aperture ratio is too low, the apertures do not sufficiently function, whereas the aperture ratio is too high, the area of the electrode surface is reduced and the efficiency of the electrolysis is turned to be lowered, thus placing these in a well-balanced conditions is necessary.

Further, in the electrolyze tank 21, there are arranged membranes 24 that are included in the electrodes-sets S[1]-S[n] and membranes 24 that are not included in the electrodes-sets S[1]-S[n]. In other words, the plurality of membranes 24 partitions the inside space of the electrolyze tank 21 into a plurality of accommodation portions 25 which individually accommodate the plurality of positive electrodes 22 and the plurality of negative electrodes 23. That is, there is disposed between the positive electrode 22 and the negative electrode 23 adjacent to each other, the membrane 24 which separates the positive electrode 22 from the negative electrode 23. The plurality of membranes 24 is, for instance, is formed to have film thickness that is substantially from 0.05 mm to 0.2 mm and is composed of, for instance, materials that are mainly polyethylene, polypropylene or the like, to which a surface treatment for providing ion exchange properties thereto has been performed. Further, the distance between membranes 24 (that is, the distance between membranes 24 that are included in the electrodes-sets S[1]-S[n] and membranes 24 that are not included in the electrodes-sets S[1]-S[n]) is set to several centimeters.

The plurality of accommodation portions 25 partitioned by the plurality of membranes 24 is respectively connected to the other end of the transferring pipe 17 that is ramified in plural corresponding thereto. Further, the accommodation portions 25 accommodating the positive electrode 22 in the plurality of accommodation portions 25 (hereinafter referred to as "positive electrode-accommodation portion 25") is respectively connected to the one end of the positive electrode-side discharging pipe 26 that is ramified in plural corresponding thereto, is connected so as to be opposed to the other end of the transferring pipe 17 locating the positive electrode 22 therebetween. Further, the accommodation portions 25 accommodating the negative electrode 23 in the plurality of accommodation portions 25 (hereinafter referred to as "negative-electrode-accommodation portion 25") is respectively connected to the one end of the negative-electrode-side discharging pipe 27 that is ramified in plural corresponding thereto, is connected so as to be opposed to the other end of the transferring pipe 17 locating the negative electrode 23 therebetween.

Thus, the aqueous solution that has been flown through the transferring pipe 17 by the transferring pump 18 is flown into the positive electrode-side discharging pipe 26 and the negative-electrode-side discharging pipe 27 followed by being flown inside of these in one direction. Subsequently, the aqueous solution is flown into the positive electrode-side discharging pipe 26 and the negative-electrode-side discharging pipe 27 and is discharged from the electrolyze tank 21 therethrough. The other end of the positive electrode-side discharging pipe 26 and the other end the negative-electrode-side discharging pipe 27 are connected to the organic-compound-extraction apparatus 30.

The flow rate of the aqueous solution that is flown in the plurality of accommodation portions 25, that is, the flow rate of the aqueous solution which is flown on the surfaces of the plurality of positive electrodes 22 and the plurality of negative electrodes 23 is subjected to be controlled so as to be within the specified range by the transferring pump 18 in the gas-absorption unit 10. The transferring pump 18 corresponds to a fluidity-providing section, of course the transferring pump 18 is not limited thereto, a fluidity-providing section may be provided at the inside of the electrolyze tank 21 that is adapted to render the aqueous solution to flow.

The organic-compound-extraction apparatus 30 is adapted to extract organic compounds contained in the aqueous solution after being electrolyzed. The organic-compound-extraction apparatus 30 is adapted to include a gaseous-organic-compound-extraction apparatus 31 and a liquid-organic-compound-extraction apparatus 32.

The gaseous-organic-compound-extraction apparatus 31 is adapted to extract gaseous-organic-compounds contained in the aqueous solution after being electrolyzed and gases dissolved in the aqueous solution, which has been generated by the electrolysis. The gaseous-organic-compound-extraction apparatus 31 is adapted to include a positive electrode-side-extraction tank 31*a* to which the other end of the positive electrode-side discharging pipe 26 is connected and a negative-electrode side-extraction tank 31*b* to which the other end of the negative-electrode-side discharging pipe 27 is connected.

The positive electrode-side-extraction tank 31*a* consists of a gas/liquid separation drum which separates and collects oxygen (02) generated when the aqueous solution passes by the positive electrode-accommodation portion 25. The positive electrode-side-extraction tank 31*a* may be configured to facilitate a recovery of the oxygen (02) generated by subjecting the inside of the system at a slight negative pressure side.

Further, the negative-electrode side-extraction tank 31*b* also consists of a gas/liquid separation drum like the positive electrode-side-extraction tank 31*a* and is adapted to extract gaseous-organic-compounds, hydrogen ($H_2$), and carbon monoxide (CO) such as methane, ethane, ethylene and formaldehyde or the like dissolved in the aqueous solution having passed through the negative-electrode-accommodation portion 25. The gas mixture separated and recovered is subjected to a purification process utilizing a combination of absorption material and separation membrane, in which the pressure and the temperature condition are suitably varied in accordance with the composition thereof.

The aqueous solution having experienced the extraction process performed by the positive electrode-side-extraction tank 31*a* and the negative-electrode side-extraction tank 31*b* are transferred to the liquid-organic-compound-extraction apparatus 32 via a pipe 33.

The liquid-organic-compound-extraction apparatus 32 is adapted to include a distilltower 32*a* to which the aqueous solution is transferred from the gaseous-organic-compound-extraction apparatus 31 via the pipe 33 and subsequently, the water-soluble organic compounds such as methanol, ethanol and propanol or the like, which is in a state of being liquid at ordinary temperatures and pressures and is converted to gas state under temperature of 100 degrees Celsius is extracted in the distilltower 32. The distilltower 32*a* is configured to perform a distillation utilizing steam produced by a heat source of a boiler or the like in this embodiment. For instance, a configuration in which distillation is performed with steam generated by utilizing heating medium such as molten salt having been heated by solar heat as a thermal storage medium may also be available.

The processed-aqueous solution-exhausting unit 40 is adapted to return a part of the aqueous solution which has been extraction processed at the organic-compound-extraction apparatus 30 to the gas-absorption unit 10. The processed-aqueous solution-exhausting unit 40 is adapted to include the processed-aqueous solution pipe 41 and a recovery pump 42.

The one and of the processed-aqueous solution pipe 41 is connected to the distilltower 32*a*, while the other end thereof is connected to the pH-measurement pipe 12. The recovery pump 42 is adapted to render the aqueous solution to flow from the one end of the processed-aqueous solution pipe 41 to the other end. Thus, the aqueous solution contained in the distilltower 32*a* is transferred to the gas-absorption unit 10 through the processed-aqueous solution pipe 41. The aqueous solution having been transferred to the gas-absorption unit 10 (more specifically, the pH-measurement pipe 12) is made to flow together with the aqueous solution that flows through the pH-measurement pipe 12, and subjected to be sprayed to the gas-phase portion of the gas-absorption tank 11 by the vaporizer 11*a*. The processed-aqueous solution pipe 41 is made ramified in the intermediate thereof and the part of the remaining aqueous solution is discharged from the ramified unit.

The control unit 50 is, for instance, composed of microcomputer equipped with CPU, ROM, RAM or the like and is adapted to administer the control of the organic-compound-generation apparatus 1 as the whole.

To the control unit 50, there are connected the pH meter 14 and the chemicals feed pump 16. The control unit 50 is adapted to obtain the pH of the aqueous solution contained in the gas-absorption tank 11 on the basis of signals transmitted from the pH meter 14, and is adapted to transmit control signals based on the obtained pH value to the chemicals feed pump 16 to let the chemicals feed pump 16 deliver the chemicals reserved in the pH-adjustment-agent tank 15 to the processed-aqueous solution pipe 41 so that the pH of the gas-absorption tank 11 is within the range from the specified range.

The control unit 50 is adapted to control such that the pH of the aqueous solution is the gas-absorption tank 11 is within the range from 5 to 10. The control unit 50 is adapted preferably to control such that the pH of the aqueous solution is within the range from 5 to 10, more preferably to control such that the pH of the aqueous solution is within the range from 6.8 to 9.9, and further more preferably to control such that the pH of the aqueous solution is within the range from 7.2 to 9.5 by adding chemicals.

Further, the control unit 50 is connected to the transferring pump 18. The control unit 50 is adapted to transmit control signals to the transferring pump 18 so as to transfer the aqueous solution from the gas-absorption tank 11 to the electrolyze tank 21 and is adapted to control the flow rate of the aqueous solution that flows in the plurality of accommodation portions 25 of the electrolyze tank 21.

The control unit 50 is adapted to control the flow rate of the aqueous solution that flows in the plurality of accommodation portions 25 so as to be within the range from 0.01 m/min to 11 m/min, preferably within the range from 2 m/min to 10 m/min, and more preferably within the range from 4 m/min to 9 m/min.

Further, the control unit 50 is connected to the pH-measurement pump 13, the recovery pump 42, not-shown power supply or the like, and the control unit 50 transmits the control signals to these units or sections so as to control the operations thereof. Further, the control unit 50 is also adapted to control the delivery of water and carbon dioxide to the gas-absorption unit 10.

Next, one example of the organic-compound-generation process in the above-described organic-compound-generation apparatus 1 is described.

The organic-compound-generation apparatus 1 delivers carbon dioxide from not-shown pipe being connected to the gas-absorption tank 11 to the gas-phase portion. Then, the organic-compound-generation apparatus 1 supplies water from not-shown pipe being connected to the pH-measurement pipe 12 so that the vaporizer 11*a* is made to spray the water into the inside of the gas-absorption tank 11. Thus, a misty water falls down absorbing carbon dioxide so that the aqueous solution consisted of water having absorbed carbon dioxide is generated within the gas-absorption tank 11 (aqueous-solution-generation process). Typically, carbon dioxide having been absorbed in water has the equilibrium reaction shown by the following formula depending on the pH of the liquid which absorbed the carbon dioxide:

$$CO_2+H_2O \Leftrightarrow H_2CO_3 \quad (1)$$

$$H_2CO_3 \Leftrightarrow H+HCO_3^- \quad (2)$$

$$HCO_3^- \Leftrightarrow H+CO_3^{2-} \quad (3)$$

Next, the organic-compound-generation apparatus 1 renders the transferring pump 18 to operate the transferring pump 18 when the aqueous solution contained in the gas-absorption tank 11 reaches a predetermined amount so that the aqueous solution is continuously transferred from the gas-absorption tank 11 to the electrolyze tank 21 through the transferring pipe 17 (transferring process). The aqueous solution having been transferred to the electrolyze tank 21 is flown in one direction within the plurality of accommodation portions 25. At this time, the transferring pump 18 is controlled so that the flow rate of the aqueous solution in the plurality of accommodation portions 25 is within the specified range.

Next, the organic-compound-generation apparatus 1 applies voltage into between the plurality of positive electrodes 22 and the plurality of negative electrodes by using a not-shown power supply. Thus, the aqueous solution having been electrolyzed in the plurality of accommodation portions 25 is transferred to the organic-compound-extraction apparatus 30 through the positive electrode-side discharging pipe 26 and the negative-electrode-side discharging pipe 27.

Next, the organic-compound-generation apparatus 1 extracts gases such as gaseous organic compound or the like from the aqueous solution having been transferred to the organic-compound-extraction apparatus 30 at the positive electrode-side-extraction tank 31*a* and the negative-electrode side-extraction tank 31*b* of the gaseous-organic-compound-extraction apparatus 31 and subsequently, the organic-compound-generation apparatus 1 extracts water-soluble organic compounds at the distilltower 32*a* of the liquid-organic-compound-extraction apparatus 32.

Next, the organic-compound-generation apparatus 1 renders the recovery pump 42 to operate to continuously transfer the part of the aqueous solution processed by the organic compounds having been extracted to the gas-absorption unit 10 through the processed-aqueous solution pipe 41 (aqueous solution recovery process). Thus, the aqueous solution having been returned to the gas-absorption unit 10 is flown together to the pH-measurement pipe 12 and is subjected to be sprayed to the gas-phase portion of the gas-absorption tank 11 from the vaporizer 11*a* and becomes the aqueous solution having absorbed carbon dioxide again. Further, the organic-compound-generation apparatus 1 discharges a part of the residue of the aqueous solution from the processed-aqueous solution pipe 41.

As such, the organic-compound-generation apparatus 1 implements the above operations so as to render the aqueous solution having absorbed carbon dioxide to be circulated such that the aqueous solution is sequentially flown from the gas-absorption unit 10, electrolytical-synthesizing unit 20 and the organic-compound-extraction apparatus 30, and performs a generation of an aqueous solution, an electrolysis, and an extraction of organic compounds.

Further, the organic-compound-generation apparatus 1 activates the pH-measurement pump 13 to flow the aqueous solution into the pH-measurement pipe 12 along with the above circulation performance. Then, the pH meter 14 is subjected to measure the pH of the aqueous solution flowing through the pH-measurement pipe, and the chemicals feed pump 16 is activated based on the measured pH to add chemicals into the aqueous solution that is flown in the processed-aqueous solution pipe 41 so that the pH of the aqueous solution is within the specified range (pH control process). Thus, the pH of the aqueous solution within the gas-absorption tank 11 is controlled so as to be within the specified range, thereby, the equilibrium state of the aqueous solution is inclined to a state where the hydrogen carbonate ion ($HCO^{3-}$) is to be increased. The aqueous solution thus the pH thereof having been controlled is delivered to the electrolytical-synthesizing unit 20 by means of the above-circulation. In other words, the organic-compound-generation apparatus 1 controls the pH of the aqueous solution to be within the specified range during the electrolysis in the electrolytical-synthesizing unit 20.

Consequently, according to this embodiment, the pH of the aqueous solution during the electrolysis is controlled so as to be within the range from 5 to 10. As such, the equilibrium state of the aqueous solution is made to be inclined to a state where the hydrogen carbonate ion ($HCO^{3-}$) is to be increased. Thereby, a greater number of hydrogen carbonate is electrolyzed resulting in a production of many organic compounds. Accordingly, the organic compounds can be generated efficiently even under a low-temperature environment.

Further, the aqueous solution having absorbed carbon dioxide is generated in the gas-absorption tank 11, the generated aqueous solution is transferred from the gas-absorption tank 11 to the individual electrolyze tank 21, and the aqueous solution having been transferred to the electrolyze tank 21 is subjected to electrolysis within the electrolyze tank 21. Further, the pH of the aqueous solution is subjected to be controlled within the gas-absorption tank 11. As such, since the aqueous solution is transferred from the gas-absorption tank 11 where the pH thereof is controlled, to the electrolyze tank 21, for instance, as compared to the case where generation and electrolysis of the aqueous solution are performed concurrently within a single cell, the effect due to the variation of the pH by electrolysis during the control of the pH, is made minimized. Thereby, the pH of the aqueous solution can be controlled avoiding a decline of the precision of the control. Accordingly, the organic compounds can be generated more efficiently even under a low-temperature environment.

Further, the aqueous solution within the plurality of accommodation portions 25 of the electrolyze tank 21 is made to frow during the electrolytic process. As such, the bubbles generated on the surface of the electrode (the positive electrodes 22 and the negative electrodes 23) is eliminated by means of the electrolysis, thereby, the increase of the electric resistance due to the presence of the bubbles can be suppressed. Accordingly, the organic compounds can be generated more efficiently even under a low-temperature environment.

Further, chemicals (base material) is added into the aqueous solution so that the pH of the aqueous solution is controlled within the range from 5 to 10, for instance, as compared to the case controlling the pH by adjusting the amount of contained oxygen (i.e., concentration), the control of adding amount of chemicals can perform a precise control of the pH of the aqueous solution in an easier way. Accordingly, the organic compounds can be generated more efficiently even under a low-temperature environment.

Further, the gas-absorption unit 10 which generates the aqueous solution having absorbed carbon dioxide, the electrolytical-synthesizing unit 20 which electrolyzes the aqueous solution generated by the gas-absorption unit 10, and the control unit 50 which controls the pH of the aqueous solution during the electrolytic process by the electrolytic section within the range from 5 to 10 are prepared. As such, due to the control by the control unit 50, the equilibrium state of the aqueous solution is made to be inclined to a state where the hydrogen carbonate ion ($HCO^{3-}$) is to be increased. Thereby a greater number of hydrogen carbonate is electrolyzed resulting in a production of many organic compounds. Accordingly, the organic compounds can be generated more efficiently even under a low-temperature environment.

Further, the gas-absorption unit 10 includes the gas-absorption tank 11 at the inside of which the aqueous solution having absorbed carbon dioxide is generated, and the above aqueous solution is subjected to an electrolysis at the inside of the electrolytical-synthesizing unit 20. The electrolytical-synthesizing unit 20 includes the electrolyze tank 21 that is independent from the gas-absorption tank 11 and the control unit 50 controls the pH of the aqueous solution at the inside of the gas-absorption tank 11. Further, the control unit 50 also includes the transferring pipe 17 and the transferring pump 18 that are adapted to transfer the aqueous solution from the gas-absorption tank 11 to the electrolyze tank 21. As such, since the aqueous solution is transferred from the gas-absorption tank 11 which controls the pH thereof, to the individual electrolyze tank 21, for instance, as compared to a case where a generation and as electrolysis of the aqueous solution is performed in an identical cell, the effect due to the variation of the pH by electrolysis during the control of the pH is made minimized. Thereby, the pH of the aqueous solution can be controlled avoiding a decline of the precision of the control. Accordingly, the organic compounds can be generated more efficiently even under a low-temperature environment.

Further, the transferring pump 18 that flows the aqueous solution contained in the plurality of accommodation portions 25 of the electrolyze tank 21. As such, the flow of the aqueous solution eliminates the bubbles generated on the surface of the electrode (the positive electrode 22 and the negative electrode 23) by means of electrolysis, thereby, an increase of the electric resistance caused by the bubbles. Accordingly, the organic compounds can be generated more efficiently even under a low-temperature environment.

Further, the aqueous solution having absorbed the carbon dioxide is made discharged from the electrolyze tank 21 immediately after the aqueous solution having absorbed carbon dioxide is flown and having been passed through the plurality of accommodation portions 25 which individually accommodates the plurality of positive electrodes 22 and the plurality of negative electrodes 23. As such, where the aqueous solution at the positive electrode 22 side contains the oxygen generated on the surface of the positive electrode 22 by the electrolysis, the oxygen is prevented from contacting the positive electrode 22 again. Further, the positive electrode 22 and the negative electrode 23 are separated by the membrane 24 so that the oxygen can be prevented from contacting the negative electrode 23. Thus, a decline of the electrode due to the contact with the oxygen can be suppressed. Accordingly, the organic compounds can be generated more efficiently even under a low-temperature environment.

Further, the plurality of positive electrodes 22 and the plurality of negative electrodes 23 are respectively formed in a plate-like shape and are arranged in parallel. Further, the positive electrodes 22 and the negative electrodes 23 that are adjacent to each other form sets among the positive electrodes 22 and the plurality of negative electrodes 23, and the inter-electrode-space distance between the adjacent positive electrodes 22 and the negative electrodes 23 that are adjacent to each other is equal to or less than 2.5 mm. As such, during the electrolytic process, although in normal, the narrower are the intervals between the electrodes, the more enhanced is the efficiency of the electrolysis, while the aqueous solution is prevented from flowing at the inter-electrode, and thereby, a removal of the bubbles is suppressed and a favorable maintenance of the efficiency is made difficult, the intervals of the plurality of positive electrodes 22 and the plurality of negative electrodes 23 are set within the above-described numerical range so that the efficiency and the maintenance of the electrolysis can be made well-balanced.

Further, in at least one of the plurality of electrode of the plurality of positive electrodes 22 and the plurality of negative electrodes 23, there is formed a plurality of apertures therethrough. As such, the aqueous solution is made more easily flown through the inter-electrode so that the removal of the bubbles is facilitated, and the efficiency of the electrolysis can be more suitably maintenanced.

Further, the control unit 50 adds chemicals (basic substance) in the aqueous solution so that the pH of the aqueous solution is controlled within the range from 5 to 10 during the electrolytic process, thereby, for instance, as compared to the control based on the amount of contained oxygen (i.e., concentration), controlling the adding amount of the base material can achieve a precise control of the pH in an easier way. Accordingly, the organic compounds can be generated more efficiently even under a low-temperature environment.

Further, the organic-compound-extraction apparatus 30 which is adapted to extract the organic compounds is prepared, and the organic-compound-extraction apparatus 30 includes the liquid-organic-compound-extraction apparatus 32 that is adapted to extract the organic compounds made dissolved in the aqueous solution after being electrolyzed is performed by the gaseous-organic-compound-extraction apparatus 31 and the electrolytical-synthesizing unit 20. The gaseous-organic-compound-extraction apparatus 31 and the electrolytical-synthesizing unit 20 are adapted to extract the organic compounds contained in gases generated by the electrolysis by the electrolytical-synthesizing unit 20. As such, gaseous-organic-compounds and water-soluble organic compounds generated by the electrolysis can be obtained.

Further, the processed-aqueous solution-exhausting unit 40 that is adapted to transfer the aqueous solution from which the organic compounds has been extracted by the liquid-organic-compound-extraction apparatus 32 to the gas-absorption unit 10 is also prepared. As such, the aqueous solution after being electrolyzed can be reused by adding carbon dioxide again thereinto.

As described above, the present invention has been described by exemplifying possible preferential form of embodiments, the organic-compound-generation apparatus and the method of generating organic compounds of the present invention are not necessarily limited to the features of the above-described embodiments.

Figure 5:
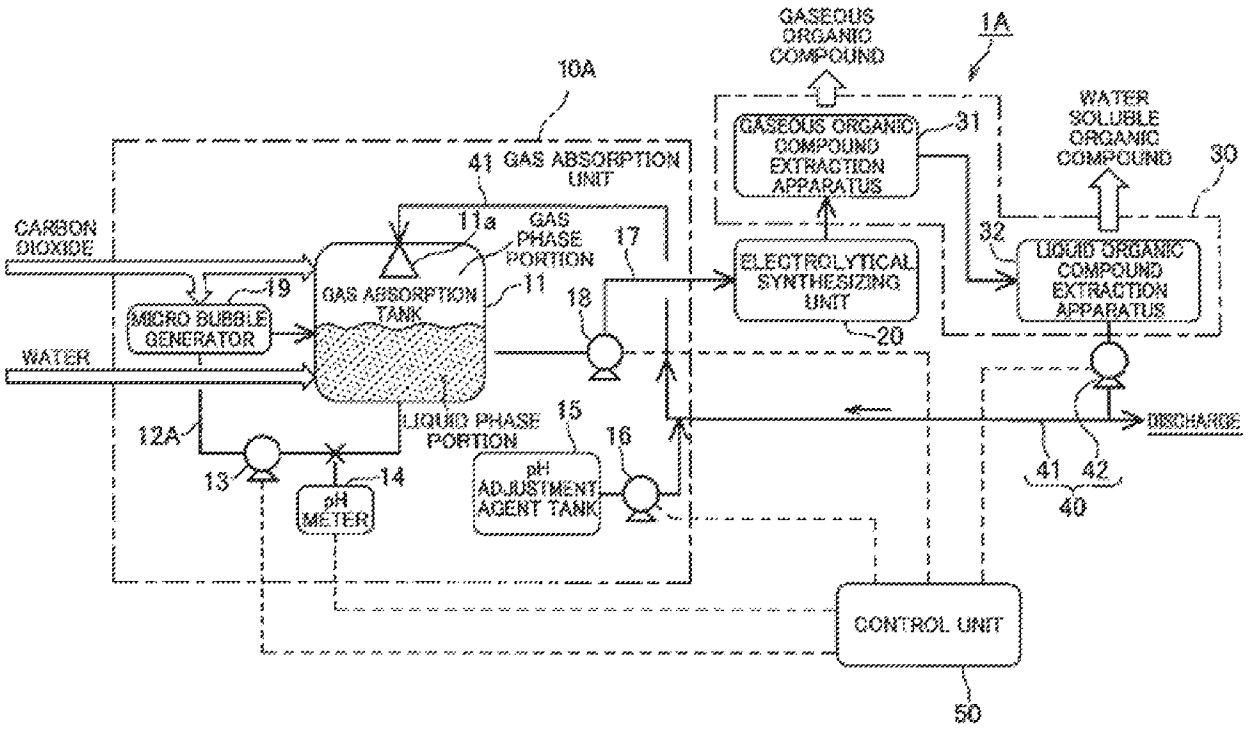
FIG. 5 is an explanatory view showing a configuration of a variation of the gas-absorption unit in FIG. 2.

For instance, in the above-described embodiment, a configuration is described in which the gaseous carbon dioxide is supplied to the gas-phase portion of the gas-absorption tank 11 in the gas-absorption unit 10, the present invention is not necessarily limited thereto. For instance, a configuration in which micro-bubble generator 19 is provided at a pH-measurement pipe 12A that is connected to the liquid-phase portion of the gas-absorption tank 11 at both one end and the other end thereof just like a gas-absorption unit 10A of the organic-compound-generation apparatus 1A shown in FIG. 5. This gas-absorption unit 10A delivers carbon dioxide to the gas-phase portion of the gas-absorption tank 11 and sprays the aqueous solution having been processed from the vaporizer 11*a* to the gas-phase portion so that carbon dioxide is made absorbed in the misty aqueous solution. The gas-absorption unit 10A further delivers carbon dioxide to a micro-bubble generator 19 and thereafter generates microbubbles of carbon dioxide in the aqueous solution being flown through the pH-measurement pipe 12A by the pH-measurement pump 13 so that carbon dioxide is made absorbed in the aqueous solution. Further, water form the outside is delivered to the liquid-phase portion of the gas-absorption tank 11. Because of such a configuration, more carbon dioxide is enabled to be absorbed in the aqueous solution. Incidentally, in FIG. 5, the same configurations as those in the above-described embodiments are omitted to describe by marking the same reference number thereto.

Figure 6:
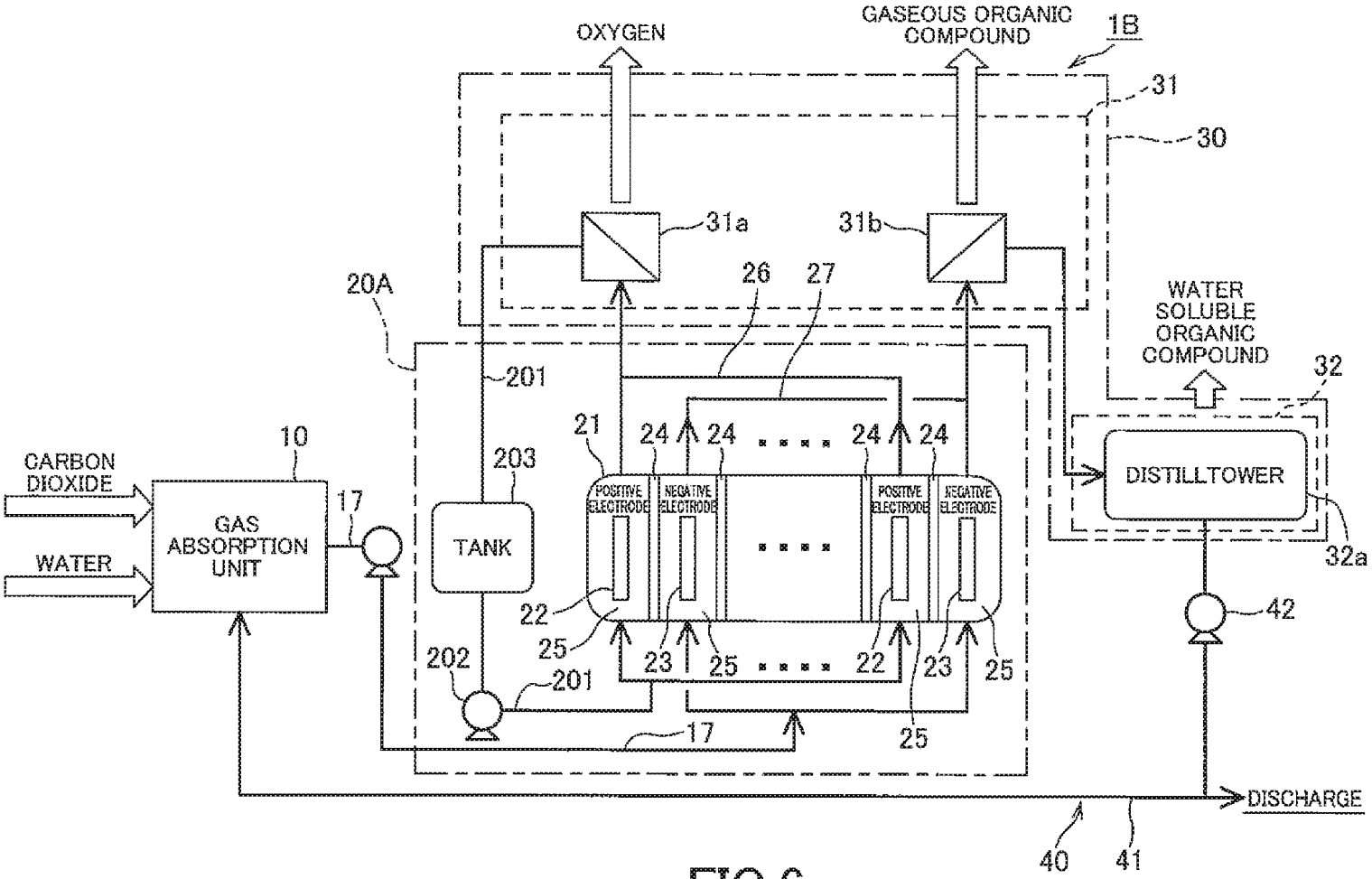
FIG. 6 is an explanatory view showing a configuration of a variation of the electrolytical-synthesizing unit and the organic-compound-generation unit in FIG. 3.

Further, at the electrolytical-synthesizing unit 20 in the above-described embodiment, a configuration is described in which the aqueous solution generated by the gas-absorption unit 10 is made flown through the plurality of accommodation portions 25 of the electrolyze tank 21 in one direction, the present invention is not necessarily limited thereto. For instance, just like the electrolytical-synthesizing unit 20A in the organic-compound-generation apparatus 1B, a configuration can be employed in which the other ends ramified in plural of the transferring pipe 17 are solely made connected to the accommodation portion 25 (negative-electrode-accommodation portion 25) which accommodates the plurality of negative electrodes 23 so that the aqueous solution generated by the gas-absorption unit 10 is made flown only at the negative-electrode-accommodation portion 25. Then, the one ends are made connected to the aqueous solution-discharged units of the positive electrode-side-extraction tank 31*a*. A circulation pipe 201 in which its accommodation portion 25 (positive electrode-accommodation portion 25) is connected to the other ends ramified in plural, a circulation pump 202 which is adapted to flow an electrolyte aqueous solution different from the above-described aqueous solution from one end of the circulation pipe 201 to the other end thereof, and a tank 203 that reserves electrolyte aqueous solution are provided so that individual-circulatory system is configured in which the electrolyte aqueous solution is made circulated in the positive electrode-accommodation portion 25 and the positive electrode-side-extraction tank 31*a*. Incidentally, in FIG. 6, the same configurations as those in the above-described embodiments are omitted to describe by marking the same reference number thereto.

The electrolyte aqueous solution is made by the disaqueous solution of, for instance, one or multiple substance(s) selected from the set consisted of lithium hydroxide (LiOH), sodium hydroxide (NaOH), potassium hydroxide (KOH), sodium carbonate ($Na_2CO_3$), potassium carbonate ($K_2CO_3$), lithium carbonate ($LiHCO_3$), sodium bicarbonate ($NaHCO_3$), potassium bicarbonate ($KHCO_3$), potassium sulfate ($K_2SO_4$) and sulfuric acid ($H_2SO_4$). Of course, the above materials are shown as one example, the other materials can be utilized insofar as not contrary to the aim of the present invention.

By configuring as such, the aqueous solution having absorbed carbon dioxide is made flown in one direction only in the negative-electrode-accommodation portion 25 in which the plurality of negative electrodes 23 is accommodated among the accommodation portions 25 and is discharged from the electrolyze tank 21 immediately after passing through the negative-electrode-accommodation portion 25. Further, other electrolyte aqueous solution separated from the above-descried electrolyte aqueous solution is made flown in one direction only in the positive electrode-accommodation portion 25 accommodating the plurality of positive electrodes 22 among the accommodation portions 25 so as to be discharged from the electrolyze tank 21 from the electrolyze tank 21 immediately after passing through the positive electrode-accommodation portion 25.

Thus, although the aqueous solution at the positive electrode 22 side after being electrolyzed contains the oxygen generated on the positive electrode 22 surface by the electrolysis, the oxygen can be prevented from contacting the positive electrode 22 again. Further, since the positive electrode 22 and the negative electrode 23 are separated from each other by the membrane, the oxygen is also enabled to be prevented from contacting the negative electrode 23. Furthermore, in the configuration in which the aqueous solution is reused after being electrolyzed, there is likely to be dissolved the oxygen generated by the electrolysis in such a reused aqueous solution, the dissolved oxygen can be prevented from contacting the negative electrode 23 by separating the electrolyte aqueous solution at the positive electrode 22 side from the aqueous solution at the negative electrode 23 side. Thus, a decline of the electrode by the contact of the oxygen can be suppressed. Accordingly, the organic compounds can be generated more efficiently even under a low-temperature environment.

Incidentally, the above-described embodiments show a representative exemplification of the present invention, the present invention is not necessarily limited to the embodiments. That is, the person skilled in the art can implement the present invention in various modified manners within the scope of the present invention. Insofar as the modification possesses the configuration of the organic-compound-generation apparatus and the method of generating organic compounds of the present invention, the modification is included in the scope of the present invention without saying.

EXAMPLES

Hereinafter, the present invention is more specifically described by exemplifying several examples.

Example 1

In the organic-compound-generation apparatus 1 of the above-described embodiments, (1) the pH of the aqueous solution generated at the gas-absorption unit 10 was controlled so as to be multiple different pH values within the range from 4 to 11. Then, gases generated while the organic compound generation process was conducted for one hour as to each aqueous solution having respective pH value and the total amount of the organic carbon (TO C; Total Organic Carbon) contained in the aqueous solution after the electrolysis were measured. Further, when the organic compounds were generated, (2) potassium sulfate ($K_2SO_4$) and sulfuric acid ($H_2SO_4$), sodium bicarbonate ($NaHCO_3$), or sodium carbonate ($Na_2CO_3$) was utilized as the chemicals for controlling the pH, (3) voltage of 3V was applied between the plurality of positive electrodes 22 and the plurality of negative electrodes 23, (4) each inter-electrode-space distance between the plurality of positive electrodes 22 and the plurality of negative electrodes 23 was set to 0.5 mm, (5) the aperture ratio of the plurality of positive electrodes 22 and the plurality of negative electrodes 23 was set to 30%, (6) the flow rate of the aqueous solution within the plurality of accommodation portions 25 was set to 2.0 m/min, and (7) the temperature of the aqueous solution was set to 30 degrees Celsius. Then, the graph obtained by plotting TOC ratio is shown in FIG. 7 where the TOC is set to 1.0 when the pH is 5.0.

Figure 7:
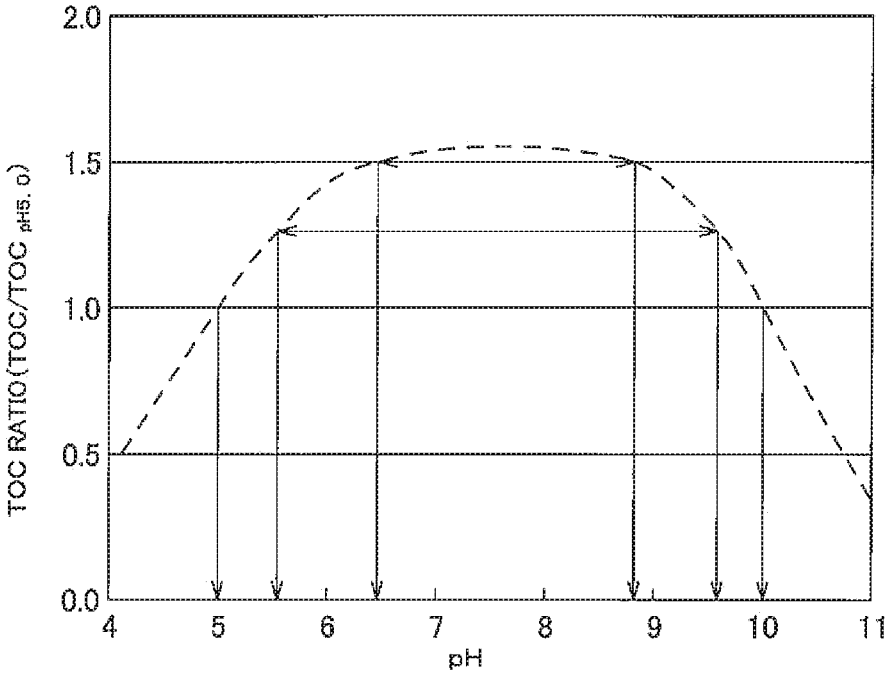
FIG. 7 is a graph showing one example of relationship between the hydrogen ion exponent of the solution that generates organic compounds by means of electrolysis and a total organic-carbon-amount ratio.

As shown in, FIG. 7, when the pH of the aqueous solution was contained within the range from 5 to 10, the TOC ratio becomes to be more than 1.0, when the pH of the aqueous solution was contained within the range from 5.5 to 9.6, the TOC ratio becomes to be more than 1.5 when the pH of the aqueous solution was contained within the range from 6.2 to 8.8, the TOC ratio becomes to be more than 1.5. Accordingly, when the pH of the aqueous solution generated at the gas-absorption unit 10 (i.e., the pH of the aqueous solution during the electrolysis) is within the above numerical range, the organic compound can be efficiently generated.

Example 2

In the organic-compound-generation apparatus 1 of the above-described embodiments, (1) each inter-electrode-space distance between the plurality of positive electrodes 22 and the plurality of negative electrodes 23 was set to mutually different multiple values, and gases generated while the organic compound generation process was conducted for one hour as to each set value and the total amount of organic carbon (TOC) contained in the aqueous solution after the electrolysis were measured. Further, when the organic compounds were generated, (2) the pH of the aqueous solution was controlled so as to be 8.5, (3) sodium bicarbonate ($NaHCO_3$) was utilized as the chemicals for controlling the pH, (4) voltage of 3V was applied between the plurality of positive electrodes 22 and the plurality of negative electrodes 23, (5) the aperture ratios of the plurality of positive electrodes 22 and the plurality of negative electrodes 23 were set to 30%, (6) the flow rate of the aqueous solution within the plurality of accommodation portions 25 was set to 6.0 m/min, and (7) the temperature of the aqueous solution was set to 30 degrees Celsius. Then, the graph obtained by plotting TOC ratio at each inter-electrode-space distance set value is shown in FIG. 8 where the TOC is set to 1.0 when the inter-electrode-space distance is at 0 mm.

Figure 8:
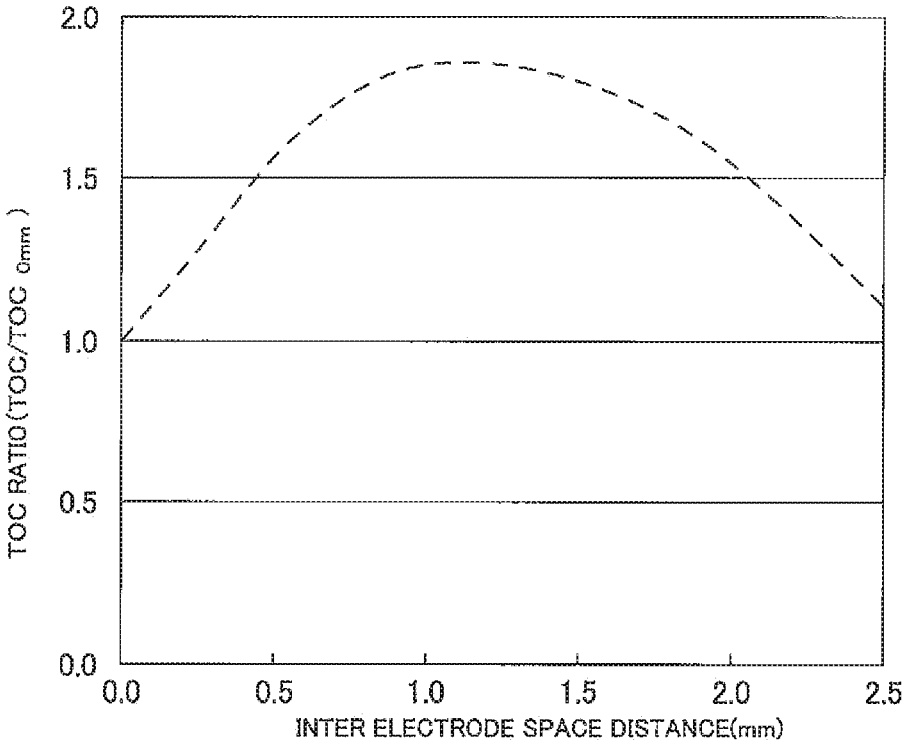
FIG. 8 is a graph showing one example of relationship between a distance (inter-electrode-space distance) between the positive electrode and the negative electrode of an electrode utilized for generating organic compound by means of electrolysis, and a total organic-carbon-amount ratio.

As shown in FIG. 8, when the inter-electrode-space distance is within the range from 0 mm to 2.5 mm, the TOC ratio becomes to be equal to or more than 1.0, and when the inter-electrode-space distance is within the range from 0.5 mm to 2.0 mm, the TOC ratio becomes to be equal to or more than 1.5. Accordingly, when each inter-electrode-space distance between the plurality of positive electrodes 22 and the plurality of negative electrodes 23 is within the above-described numerical range, the organic compound can be efficiently generated.

Example 3

In the organic-compound-generation apparatus 1 of above-described embodiments, (1) the aperture ratios of the plurality of electrode 22 and the plurality of negative electrodes 23 were set to mutually different multiple values, and gases generated while the organic compound generation process was conducted for one hour as to each set value and the total amount of organic carbon (TOC) contained in the aqueous solution after the electrolysis were measured. Further, when the organic compounds were generated, (2) the pH of the aqueous solution was controlled so as to be 8.5, (3) potassium bicarbonate ($KHCO_3$) was utilized as the chemicals for controlling the pH, (4) voltage of 3V was applied between the plurality of positive electrodes 22 and the plurality of negative electrodes 23, (5) each inter-electrode-space distance between the plurality of positive electrodes 22 and the plurality of negative electrodes 23 was set to 0.5 mm, (6) the flow rate of the aqueous solution within the plurality of accommodation portions 25 was set to 2.0 m/min, and (7) the temperature of the aqueous solution was set to 30 degrees Celsius. Then, the graph obtained by plotting TOC ratio at each aperture ratio set value is shown in FIG. 9 where the TOC is set to 1.0 when the aperture ratio is at 0%.

Figure 9:
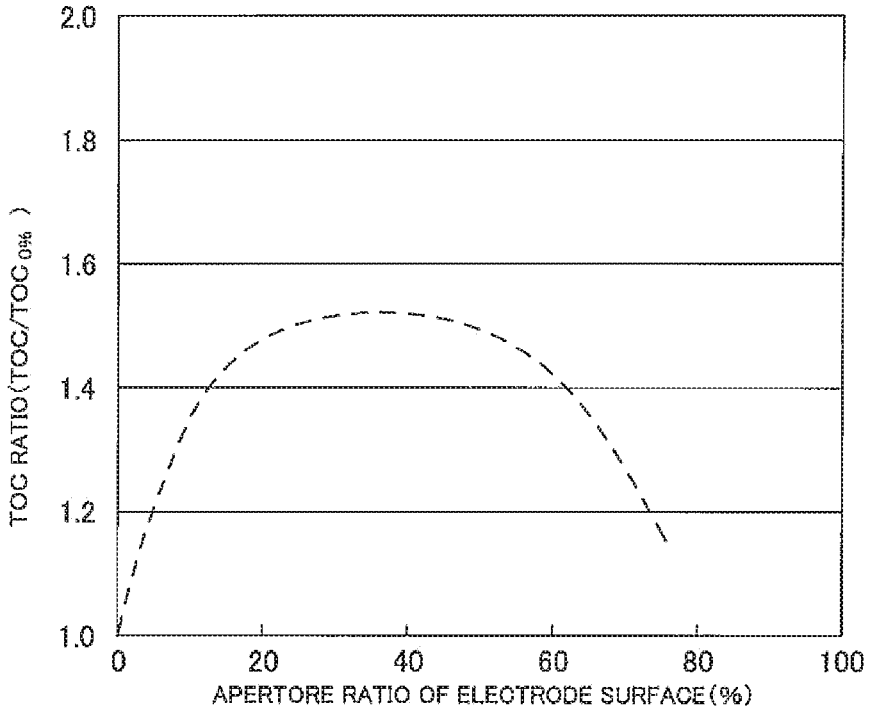
FIG. 9 is a graph showing one example of relationship between an aperture ratio of an electrode used for generating organic compound by utilizing an electrolysis, and a total organic-carbon-amount ratio.

As shown in FIG. 9, when the aperture ratio is within the range from 10% to 70%, TOC ratio becomes to be equal to or more than 1.2, and when the aperture ratio is within the range from 20% to 60%, the TOC ratio becomes to be equal to or more than 1.4. Accordingly, when the aperture ratios of the plurality of positive electrodes 22 and the plurality of negative electrodes 23 is within the above-described numerical range, the organic compounds can be efficiently generated.

Example 4

In the organic-compound-generation apparatus 1 of above-described embodiments, (1) the flow rates of the aqueous solution being flown in the plurality of accommodation portions 25 were set to mutually different multiple values, and gases generated while the organic compound generation process was conducted for one hour as to each set value and the total amount of organic carbon (TOC) contained in the aqueous solution after the electrolysis process were measured. Further, when the organic compounds were generated, (2) the pH of the aqueous solution was controlled so as to be 8.5, (3) sodium bicarbonate ($NaHCO_3$) was utilized as the chemicals for controlling the pH, (4) voltage of 3V was applied between the plurality of positive electrodes 22 and the plurality of negative electrodes 23, (5) each inter-electrode-space distance between the plurality of positive electrodes 22 and the plurality of negative electrodes 23 was set to 0.5 mm, (6) the f aperture ratios of plurality of positive electrodes 22 and the plurality of negative electrodes 23 were set to 30%, and (7) the temperature of the aqueous solution was set to 30 degrees Celsius. Then, the graph obtained by plotting TOC ratio at each flow rate set value is shown in FIG. 9 where the TOC is set to 1.0 when the flow rate is at 0 m/min.

Figure 10:
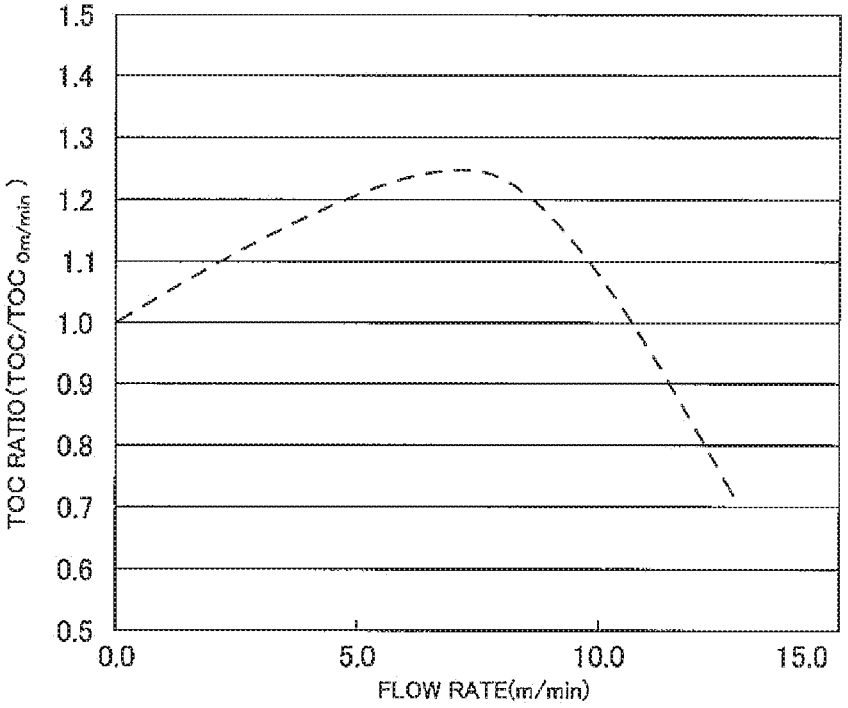
FIG. 10 is a graph showing one example of relationship between a flow rate of the aqueous solution being flown in the electrolyte-layer to be electrolyzed, and a total organic-carbon-amount ratio.

As shown in FIG. 10, when the flow rate is within the range from 0 m/min to 11 m/min, the TOC ratio becomes to be equal to or more than 1.00, when the flow rate is within the range from 2 m/min to 10 m/min, the TOC ratio becomes to be equal to or more than 10, when the flow rate is within the range from 4 m/min to 9 m/min, the TOC ratio becomes to be equal to or more than 1.15, and when the flow rate is within the range from 6 m/min to 8 m/min, the TOC ratio becomes to be equal to or more than 1.0. Further, when the flow rate surpasses 11 m/min, the TOC ratio becomes to be less than 1.00, the efficiency of the generation of the organic compounds is decreased. Accordingly, when the flow rate of the aqueous solution that flows in the plurality of accommodation portions 25 is within the above-described numerical range, the organic compounds can be efficiently generated.

(Observations)

From the above results, it can be observed that by controlling within a specified range or setting to a specified value as to the pH of the aqueous solution, the inter-electrode-space distance, the aperture ratio of the electrode, and the flow rate of the aqueous solution, the organic compounds can be efficiently generated even when the aqueous solution is kept at a low temperature.

BRIEF EXPLANATION OF REFERENCE NUMBERS

1 organic-compound-generation apparatus
10 gas-absorption unit (aqueous-solution-generation section)
11 gas-absorption tank (generation vessel)

12 pH-measurement pipe
13 pH-measurement pump
14 pH meter
15 pH-adjustment-agent tank
16 chemicals feed pump
17 transferring pipe (transferring unit)
18 transferring pump (transferring unit, fluidity-providing section)
20 electrolytical-synthesizing unit (electrolytic section)
21 electrolyze tank (electrolytic cell)
22 positive electrode
23 negative electrode
24 membrane
25 accommodation portion
30 organic-compound-extraction apparatus
31 gaseous-organic-compound-extraction apparatus (gaseous-organic-compound-extraction section)
32 liquid-organic-compound-extraction apparatus (liquid-organic-compound-extraction section)
40 processed-aqueous solution-exhausting unit (liquid-delivering section)
50 control unit (pH controller)

What is claimed is:

1. A method for generating an organic compound comprising:

generating the organic compound by electrolyzing an aqueous solution containing carbon dioxide by using a positive electrode, a negative electrode and a membrane disposed between the positive electrode and the negative electrode; wherein the generating the organic compound comprises:

providing the aqueous solution containing carbon dioxide to the positive electrode and the negative electrode in an electrolytic cell, controlling a pH of the aqueous solution within a range from 5 to 10 during an electrolysis; and applying a voltage between the positive electrode and the negative electrode during the electrolysis, wherein the aqueous solution is provided directly as an electrolyte into the positive electrode and the negative electrode in the electrolytic cell; and the electrolytic cell further comprises the membrane disposed between the positive electrode and the negative electrode.

2. The method of generating organic compound according to claim 1, further comprising:

absorbing carbon dioxide in water in a generation vessel so that the aqueous solution is generated;

transferring the aqueous solution from the generation vessel to the electrolytic cell independent from the generation vessel; and electrolyzing the aqueous solution in the electrolytic cell, wherein the pH of the aqueous solution is controlled so as to be within the range from 5 to 10 in the generation vessel.

3. The method of generating organic compound according to claim 2, wherein during electrolysis, the aqueous solution in the electrolytic cell is made to flow.

4. The method of generating organic compound according to claim 1, wherein the pH of the aqueous solution is controlled so as to be within the range from 5 to 10 during the electrolysis by adding a basic substance in the aqueous solution.

5. The method of generating organic compound according to claim 1, wherein the positive electrode is provided as a plurality of positive electrodes;

wherein the negative electrode is provided as a plurality of negative electrodes, wherein the plurality of positive electrodes and the plurality of negative electrodes are respectively provided with an aperture so that an aperture ratio is within the range from 25% to 50%, and wherein the aperture ratio is a ratio of the total areas of aperture to the external projected area of-the positive electrodes and the negative electrodes.

6. The method of generating organic compound according to claim 1, wherein an inter-electrode-space distance is set within the range from 0.8 mm to 1.4 mm, and wherein the inter-electrode-space distance means a distance obtained by subtracting the thickness of the membrane from the distance between the positive electrode and the negative electrode.

* * * * *